United States Patent [19]

Andis et al.

[11] Patent Number: 4,833,283

[45] Date of Patent: May 23, 1989

[54] HAND-HELD BLOWER WITH INTERIOR WATERPROOF SWITCH ASSEMBLY

[75] Inventors: Matthew L. Andis; Richard Urbush, both of Racine, Wis.

[73] Assignee: Andis Company, Racine, Wis.

[21] Appl. No.: 145,109

[22] Filed: Jan. 19, 1988

Related U.S. Application Data

[63] Continuation-in-part of Ser. No. 12,510, Feb. 9, 1987, Pat. No. 4,742,199.

[51] Int. Cl.[4] ..... H01H 9/04

[52] U.S. Cl. ..... 200/302.1; 200/331; 200/547; 219/533

[58] Field of Search ..... 200/302.1, 302.2, 331, 200/338, 157; 219/507, 533, 534

[56] References Cited

U.S. PATENT DOCUMENTS

| | | | |
|---|---|---|---|
| 1,869,646 | 8/1932 | Anderson | 200/302.1 |
| 3,398,250 | 8/1968 | Bowers | 200/157 |
| 3,648,001 | 3/1972 | Anderson et al. | 200/157 |
| 4,105,882 | 8/1978 | Ulbing et al. | 200/157 |
| 4,280,026 | 7/1981 | Alessio | 200/157 |
| 4,342,894 | 8/1982 | Scott et al. | 200/304 |
| 4,395,608 | 7/1983 | Eicker et al. | 200/153 L |
| 4,520,256 | 5/1985 | Doyle | 219/225 |
| 4,641,010 | 2/1987 | Abura et al. | 219/533 |
| 4,658,116 | 4/1987 | Tsang et al. | 200/302.2 X |
| 4,751,485 | 6/1988 | Fujio et al. | 200/157 X |

*Primary Examiner*—Renee S. Luebke

*Attorney, Agent, or Firm*—Michael, Best & Friedrich

[57] ABSTRACT

Disclosed herein is an electrically operated appliance, such as a hair dryer, a hair clipper, or a hair blower, which appliance comprises an elongated handle including cooperating first and second handle pieces, means for assembling together the first and second handle pieces, a water-proof switch assembly including an electrical switch and a movable acuator, ribs and yokes integrally extending from and within the handle pieces and engaged with surfaces on the switch assembly to immoveably locate the switch assembly within the handle and with the actuator extending lengthwise of the handle, and a switch operating slide carried by the handle for movement relative thereto lengthwise of the handle and connected to the actuator for movement thereof in response to slide movement.

6 Claims, 1 Drawing Sheet

HAND-HELD BLOWER WITH INTERIOR WATERPROOF SWITCH ASSEMBLY

RELATED APPLICATION

This application is a continuation-in-part of my earlier application Ser. No. 012,510 filed Feb. 9, 1987, now U.S. Pat. No. 4,742,199 and entitled Hand-Held Dryer with Waterproof Switch Assembly Chamber for Electrical Switch, which application is incorporated herein by reference.

BACKGROUND OF THE INVENTION

The invention relates to hand-held appliances, such as hair clippers, hair dryers, hair blowers, curling irons, or the like, and to the use of waterproof switches in such appliances to reduce the danger of electrocution in the event the appliance becomes wet.

Waterproof switches are relatively expensive to manufacture and it is important to avoid such expensive costs in the very competitive appliance market.

In one prior device, a sealed chamber was formed in a wall supported member to house a relatively inexpensive switch by providing a recess in the wall supporting member and by closing and sealing the recess with a gasket and a cover, which gasket admitted electrical leads and a movable actuator into the sealed recess to effect switch operation while maintaining water tight integrity.

As mentioned, this device was wall mounted and was not adapted to be hand-held. Such a device is shown in U.S. Pat. No. 4,659,907, filed Mar. 21, 1983, but there is no disclosure in this application of a switch located in a sealed recess.

Attention is directed to the following U.S. patents:

| | | |
|---|---|---|
| Ulbing, et al. | 4,105,882 | Issued: August 8, 1978 |
| Scott, et al. | 4,342,894 | Issued: August 3, 1982 |
| Eicker, et al. | 4,395,608 | Issued: July 26, 1983 |
| Doyle | 4,520,256 | Issued: May 28, 1985 |
| Anderson | 1,869,646 | Issued: August 2, 1932 |

Attention is also directed to British Patent document: Great Britian No. 2,163,294.

OBJECT OF THE INVENTION

An object of the invention disclosed herein is to economically provide a hand-held appliance including a handle having immoveably located therein a water proof switch assembly.

SUMMARY OF THE INVENTION

The invention provides an electrically operated appliance, such as a hair dryer, a hair clipper, or a hair blower, which appliance comprises an elongated handle including cooperating first and second handle pieces, means for assembling together the first and second handle pieces, a water-proof switch assembly including an electrical switch and a movable acutator, means on the handle and on the switch assembly for engagement therebetween incident to assembly together of the handle pieces so as to immoveably locate the switch assembly within the handle and with the actuator extending lengthwise of the handle, and switch operating means carried by the handle for movement relative thereto lengthwise of the handle and connected to the actuator for movement thereof in response to movement of the switch operating means.

The invention also provides an electrically operated appliance, such as a hair dryer, a hair clipper, or a hair blower, which appliance comprises an elongated handle including a first handle piece including an integrally extending portion having therein a U-shaped recess and a pair of spaced integrally extending yokes, a second handle piece adapted to cooperate with the first handle piece to form the handle and including an integrally extending portion having therein a U-shaped recess, means for assembling together the first and second handle pieces, a water-proof switch assembly including a water-tight housing having outer side surfaces cradled in the recesses of the portions to prevent housing movement transversely of the handle, which housing also includes outer end surfaces engaged by the yokes to prevent housing movement lengthwise of the handle, whereby the switch assembly is immoveably located within said handle, said housing also including at one end, a bellows including an outer end having therein an opening, an electrical switch, and a switch operating plunger extending through said bellows opening, movable substantially rectilinearly, and including an outer end, and a slide mounted on the handle for movement relative thereto lengthwise of the handle and including an arm extending inwardly of the handle and connected to the plunger outer end so as to move the plunger in common with movement of the slide and thereby to operate the switch.

Other features and advantages of the invention will become known by reference to the following general description, claims and appended drawings.

THE DRAWINGS

Figure 2:
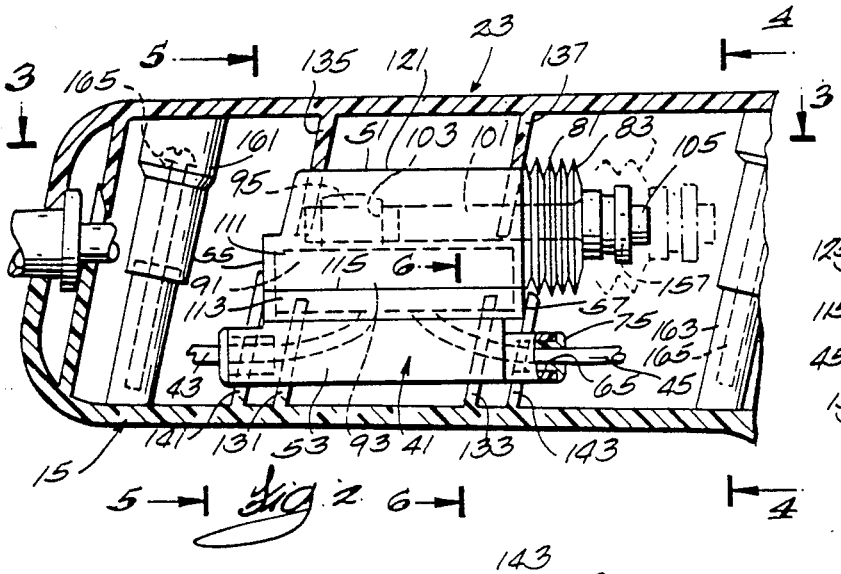
FIG. 2 is a partial view, partially in section, of the handle of the blower shown in FIG. 1.
Figure 4:
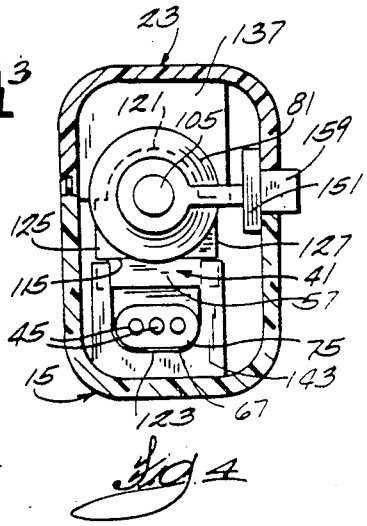
FIG. 4 is a sectional view taken along line 4—4 of FIG. 2.
Figure 3:
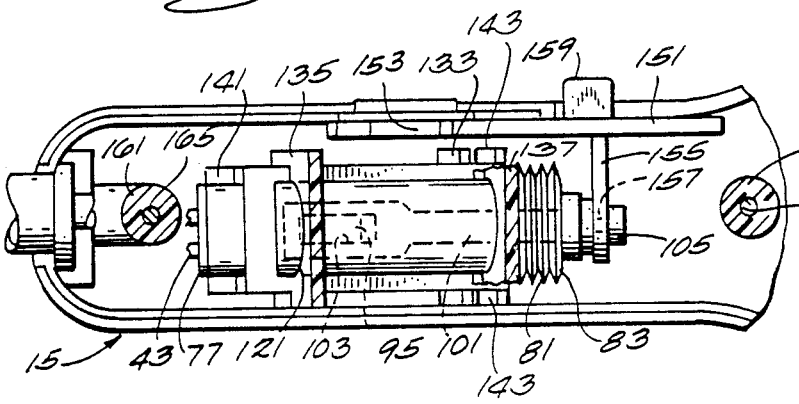
FIG. 3 is a sectional view taken along line 3—3 of FIG. 2.
Figure 5:
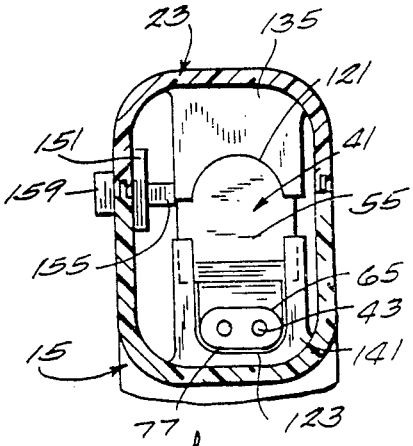
FIG. 5 is a sectional view taken along line 5—5 of FIG. 2.
Figure 1:
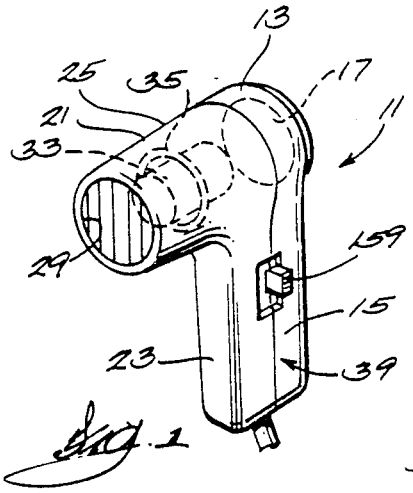
FIG. 1 is a perspective view of a hair blower incorporating various of the features of the invention.
Figure 6:
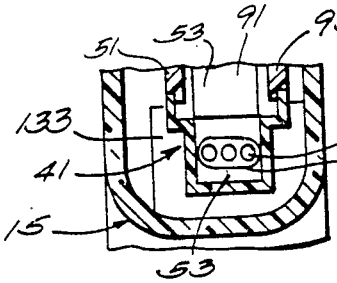
FIG. 6 is a frogmentary sectional view taken along line 6—6 of FIG. 2.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in the drawings is a hand held hair blower 11 of the type generally shown in U.S. Pat. No. 4,538,362 issued Sept. 3, 1985.

The blower 11 comprises a housing formed by two members 13 and 21. One member or piece 13 is integrally formed to provide a handle portion or piece 15, and an air inlet 17. The other piece or member 21 is formed to include a handle portion or piece 23, and a cylindrical or conical portion 25 which, at one end, includes an air outlet 29.

Supported within the conical portion 25 is a sleeve (not shown) which supports an electrically operated motorized fan 33 and an electrically operated heating device 35 (both shown schematically). Accordingly, when the fan 33 is energized, air is forced into the air inlet 17 and out of the air outlet 29, and when the heating device 35 is energized, such air is also heated.

The handle portions or pieces 15 and 23 form an elongated handle 39 which interiorly includes a water-proof switch assembly 41 (See FIG. 2) connected to an electrical line which includes two leads 43 leading to a suitable source of electrical energy (not shown) and to a circuit which includes three leads 45 leading to the heating device 35 and the electrical fan 33. The handle pieces 13 and 23 have respective exterior surfaces and respective mating edge surfaces which respectively extend from the exterior surfaces and which respectively mate with each other. As thus far described, the construction is conventional.

The switch assembly 41 comprises a housing 51 which includes a hollow interior 53 and which is suitably constructed of a plastic material which is an electrical insulator. The housing 51 also includes ends 55 and 57 which include respective openings 65 and 67 through which the leads 43 and 45 respectively pass. Suitable watertight gaskets 75 and 77 are respectively located around the leads 43 and 45 and in the openings 65 and 67 to prevent entry of moisture into the interior 53 of the housing 51.

The housing 51 also includes, at the end 57, a flexible bellows 81 with an interior communicating with the interior 53 of the housing 51 and with an outer end 83 having therein an opening.

Located within the housing 51 is a simple electrical switch 91 which can be of any suitable construction and which includes a main body 93 and an extending switch operator or button 95 which is moveable to actuate the switch. Extending adjacent the main body 93 within the housing 51 is a switch actuator or element or plunger 101 which, at one end, includes an opening 103 receiving the switch operator or button 95, and which, at the other end 105, extends through the opening at the outer end 83 of the bellows 81 in watertight relation thereto. The actuator or plunger 101 is guided for switch actuating movement by the interior walls of the housing 51 and, as indicated extends through, and out of, the bellows 81 to facilitate actuation of the switch 91 by movement of the other or outer end 105 of the actuator or plunger 101.

Preferably, the housing is formed from two parts 111 and 113 which mate together along a mating plane 115 and which are adhesively sealed together in water-tight relation and with the switch 91 immoveably located therein and with the switch actuator or plunger 101 in assembled relation to the switch button 95 and guided for substantially rectilinear movement through and/or with the bellows 81 to actuate the switch 91. Accordingly, the switch assembly 41 is water-tight and the actuator or plunger 101 extends therefrom and is movable to operate the switch 91 contained in the switch assembly 41.

As shown, the switch assembly 41 includes a first pair of opposed top and bottom sides surface 121 and 123 which extend generally parallel to the mating plane 115, together with a second pair of opposed side surfaces 125 and 127 which are transverse to the mating plane. In addition, the housing 51 includes, as already indicated, the opposite ends 55 and 57.

The handle 39 also includes means engageable with the switch assembly 41 for immovably locating the switch assembly 41 within the hollow interior of the handle 39. More particularly, the handle 39 includes means engaging the water-proof switch assembly 41 for preventing movement thereof transversely of and lengthwise of the handle 37. While other constructions could be employed, in the disclosed construction, such means includes at least one rib or portion 131 and 133 extending integrally from the spaced longitudinally of the handle piece 15 and at least one rib or portion 135 and 137 extending integrally from and spaced longitudinally of the other handle piece 21, which ribs 131, 133, 135 and 137 engage the outer side surfaces 121, 123, 125 and 127 of the switch assembly 41 to prevent switch assembly movement transversely of the length of the handle 39.

More specifically, each of the ribs 121, 123, 125 and 127 includes a U-shaped recess having an edge surface dimensioned to receive and embrace the opposite side surfaces of the switch assembly 51 and the adjacent side surface connecting the engaged side surfaces. In addition, such means also includes handle portions located to engage the ends 55 and 57 of the switch assembly 51 to prevent movement thereof lengthwise of the handle 39. While various arrangements can be employed, in the illustrated construction, the handle piece 15 integrally includes a pair of members or yokes 141 and 143 which are spaced lengthwise of the handle 39 and which respectively engage the ends 55 and 57 of the housing 51.

Means are also provided for operably connecting the interior actuator or plunger 101 to an exterior actuating means to affect switch operation in response to operator activity. While various arrangements can be employed, in the disclosed construction, the actuating means includes an exterior actuator or slide 151 which is slideably mounted for movement in the direction of handle elongation by suitable guide means formed in conventional fashion adjacent to mating surfaces of the handle pieces 15 and 23.

Means are also provided for operably connecting the interior actuator or plunger 101 and the exterior actuator or slide 151 for common movement. While other arrangements can be employed, in the disclosed construction, the exterior actuator or slide 151 includes a main portion 153 which slideably extends in a suitable elongated guideway in the handle 39, an arm 155 which extends from the main portion 153 and inwardly of the handle 39 and which, at its outer end, frictionally grips a neck 157 on the outer end 105 of the interior actuator or plunger 101. In addition, the slide 151 includes a nob 159 which extends through an opening in the handle 39 and which is accessible by an operator. Accordingly manual movement of the exterior actuator or slide 151 in the direction of handle elongation, causes similar movement of the interior actuator or plunger 101 which, in turn, displaces the switch button 95 between its positions.

Means are also provided for fastening together the handle pieces 15 and 23 so as to immovably locate the switch assembly 41 in place between the handle pieces 15 and 23 and to prevent movement of the switch assembly 41. While various other arrangements can be employed, in the disclosed construction, each of the handle pieces 15 and 23 includes, on opposite sides of the switch assembly 41, and in spaced relation thereto, inwardly extending bosses 161 and 163. The bosses 161 and 163 on one of the handle pieces 15 and 23, preferably the handle piece 23, are apertured to respectively permit free passage therein of a pair of self tapping screws 165 which are threaded into the bosses 161 and 163 in the other handle piece 15 to locate the handle pieces 15 and 23 in tightly adjacent relation to each other and so as to enclose and immovably locate the switch assembly 41.

During assembly, the switch assembly 41 is simply placed between the ribs 131 and 133 and the yokes 141 and 143 extending integrally from the handle piece 15. The exterior slide 151 is then placed in the guide means with the arm 153 connected to the neck 157 of the plunger 101. The other handle piece 23 is then oriented in mating relation to the first handle piece 15 and with the ribs 135 and 137 embracing the switch assembly 41. The screws 165 are then employed to securely hold together the two handle pieces 15 and 23 with the water-tight switch assembly 41 immovably located in the interior of the handle 39.

Various of the features of the invention are set forth in the following claims.

We claim:

1. An electrically operated appliance, such as a hair dryer, a hair clipper, or a hair blower, said appliance comprising an elongated handle including cooperating first and second handle pieces, means for assembling together said first and second handle pieces, a water-proof switch assembly including a housing which includes therein an opening and which is otherwise water-tight, an electrical switch located in said water-tight housing and including a movable actuator extending in water-tight relation through said opening, means on said handle and on said water-tight housing for engagement therebetween incident to assembly together of said handle pieces so as to immovably locate said water-tight housing within said handle and with said actuator extending lengthwise of said handle, and switch operating means carried by said handle for movement relative thereto lengthwise of said handle and connected to said actuator for movement thereof in response to movement of said switch operating means.

2. An appliance in accordance with claim 1 wherein said means immovably locating said water-tight housing includes, on said housing, outer surfaces extending lengthwise of said handle and end surfaces extending transversely of said handle, wherein said means for immovably locating said water-tight housing also includes, on said handle pieces, means engaging with said housing outer surfaces for preventing movement of said housing transversely of said handle, and wherein said means for immovably locating said water-tight housing also includes, on one of said handle pieces, means for engaging said housing end surfaces for preventing movement of said switch assembly lenghtwise of said handle.

3. An appliance in accordance with claim 1 wherein said water-tight housing is located and immovably retained in position within said handle solely by engagement with said handle pieces incident to assembly together of said handle pieces.

4. An appliance comprising an elongated handle including cooperating first and second handle pieces, means for assembling together said first and second handle pieces, a water-proof switch assembly including a water-tight housing having, at one end, a bellows including an outer end having therein an opening, an electrical switch located inside said water-tight housing and including a switch operating button, and a plunger extending in water-tight relation through said opening in said bellows, being connected interiorly of said housing to said switch button for switch operation in response to plunger movement relative to said housing, and including an outer end exterior to said housing, means on said handle and on said switch assembly for engagement therebetween incident to assembly together of said handle pieces so as to immoveably locate said switch assembly within said handle, and a slide mounted on said handle for movement lengthwise thereof and including an arm extending inwardly of said handle and connected to said plunger outer end so as to move said plunger in common with movement of said slide and thereby to operate said switch.

5. An electrically operated appliance, such as a hair dryer, a hair clipper, or a hair blower, said appliance comprising an elongated handle including a first handle piece including an integrally extending portion having therein a U-shaped recess and a pair of spaced integrally extending yokes, a second handle piece adapted to cooperate with said first handle piece to form said handle and including an integrally extending portion having therein a U-shaped recess, means for assembling together said first and second handle pieces, a water-proof switch assembly including a water-tight housing having outer side surfaces cradled in said recesses of said portions to prevent housing movement transversely of said handle, said housing also including outer end surfaces engaged by said yokes to prevent housing movement lengthwise of said handle, whereby said switch assembly is immoveably located within said handle, said housing also including at one end, a bellows including an outer end having therein an opening, an electrical switch located inside said water-tight housing, and a switch operating plunger extending through said bellows opening, movable substantially rectilinearly, and including an outer end, and a slide mounted on said handle for movement relative thereto lengthwise of said handle and including an arm extending inwardly of said handle and connected to said plunger outer end so as to move said plunger in common with movement of said slide and thereby to operate said switch.

6. An appliance in accordance with claim 5 wherein said switch is located and immovably retained in position within said handle solely by engagement with said ribs and said yokes incident to assembly together of said handle pieces.

* * * * *